United States Patent [19]

Tack, Jr.

[11] Patent Number: 4,653,311

[45] Date of Patent: Mar. 31, 1987

[54] SHORT STROKE PRESS WITH AUTOMATED FEED MECHANISM

[75] Inventor: Carl E. Tack, Jr., Carol Stream, Ill.

[73] Assignee: Avondale Industries, Inc., Chicago, Ill.

[21] Appl. No.: 824,612

[22] Filed: Jan. 31, 1986

[51] Int. Cl.[4] ..... B21J 43/02

[52] U.S. Cl. ..... 72/443; 72/421; 72/417; 72/405; 72/21

[58] Field of Search ..... 72/21, 22, 23, 24, 421, 72/405, 425, 417, 420, 419, 443, 25, 404; 100/43, 45

[56] References Cited

U.S. PATENT DOCUMENTS

| | | | |
|---|---|---|---|
| 2,073,239 | 3/1937 | Byerlein | 72/443 |
| 3,130,699 | 4/1964 | Ward | 72/417 |
| 3,199,439 | 8/1965 | Danly | 414/749 |
| 3,199,443 | 8/1965 | Danly | 414/749 |
| 3,855,839 | 12/1974 | Lose et al. | 72/417 |
| 4,062,213 | 12/1977 | Schneider et al. | 72/24 |
| 4,120,185 | 10/1978 | Schneider et al. | 72/21 |
| 4,510,570 | 4/1985 | Yonekura | 72/21 |

FOREIGN PATENT DOCUMENTS

| | | | |
|---|---|---|---|
| 1190791 | 5/1970 | United Kingdom | 72/21 |

*Primary Examiner*—R. L. Spruill
*Assistant Examiner*—David B. Jones
*Attorney, Agent, or Firm*—Leydig, Voit & Mayer

[57] ABSTRACT

A method of controlling a press having a slide mechanism mounted for reciprocating movement, a press drive for cycling the slide mechanism and including a press drive shaft and a mechanism for driving the shaft at a controllable angular velocity, and an automated feed mechanism for transferring workpieces in and out of at least one work station in the press in synchronism with the reciprocating movement of the press slide, the method comprising the steps of driving the press drive shaft at a first, relatively fast angular velocity during a "closed" portion of each cycle of reciprocating movement of the press slide, the "closed" portion of each cycle including that portion of the cycle during which the press slide is working one or more workpieces, and driving the press drive shaft at a second angular velocity, slower than the first angular velocity, during an "open" portion of each cycle of reciprocating movement of the press slide, the second angular velocity being sufficiently slow to allow the automatic feed mechanism to transfer workpieces in and out of the work station in the press during the "open" portion of each cycle.

9 Claims, 12 Drawing Figures

SHORT STROKE PRESS WITH AUTOMATED FEED MECHANISM

FIELD OF INVENTION

The present invention relates generally to power presses and is particularly useful in transfer presses having servo-driven feed mechanisms.

Power presses are typically designed with the stroke of the press long enough to allow adequate time for the feed mechanism to execute its transfer cycle while the dies of the press are open, i.e., while the press slide is far enough above the workpieces to permit them to be accessed by the feed mechanism. As the stroke of the press is lengthened, the cost of the press increases not only because of the larger press size required for the longer stroke, but also because the increased torque demand of the longer stroke requires larger and higher-powered clutches and brakes. This also results in an undesirably high impact velocity which, in turn, produces high noise levels and increased die wear rates.

This problem exists not only in transfer presses, which have multiple work stations within a single press, but also in single-station presses operating alone or in a synchronized line of such presses. Each single-station press normally has both a loading mechanism and an unloading mechanism associated with it, and the cycle time of these mechanisms can be even longer than that of the feed mechanism in a transfer press, thereby requiring even longer press strokes.

SUMMARY OF THE INVENTION

It is a primary object of the present invention to provide an improved power press which reduces the size and cost of the press while at the same time providing a very low impact velocity and allowing adequate time for the feed mechanism, or the loading and unloading mechanisms, to operate during the "open" portion of the press cycle. In this connection, a related object of the invention is to provide such an improved press which permits the use of relatively small and less expensive clutches and brakes which consume less power than the clutches and brakes used in comparable presses today.

It is another important object of this invention to provide such an improved press which reduces the noise levels and die wear rates by reducing the impact velocity.

A further object of this invention is to provide such an improved press which offers relatively low overall energy consumption rates for any given amount of work.

Still another object of this invention is to provide such an improved press which has a relatively short stroke length, e.g., a stroke length only half as long as the stroke of presses currently used for the same purposes.

A still further object of the invention is to provide an improved method of operating power presses, which can be implemented by retrofitting presses already in the field.

Other objects and advantages of the invention will be apparent from the following detailed description and the accompanying drawings.

DETAILED DESCRIPTION OF PREFERRED EMBODIMENTS

Figure 1:
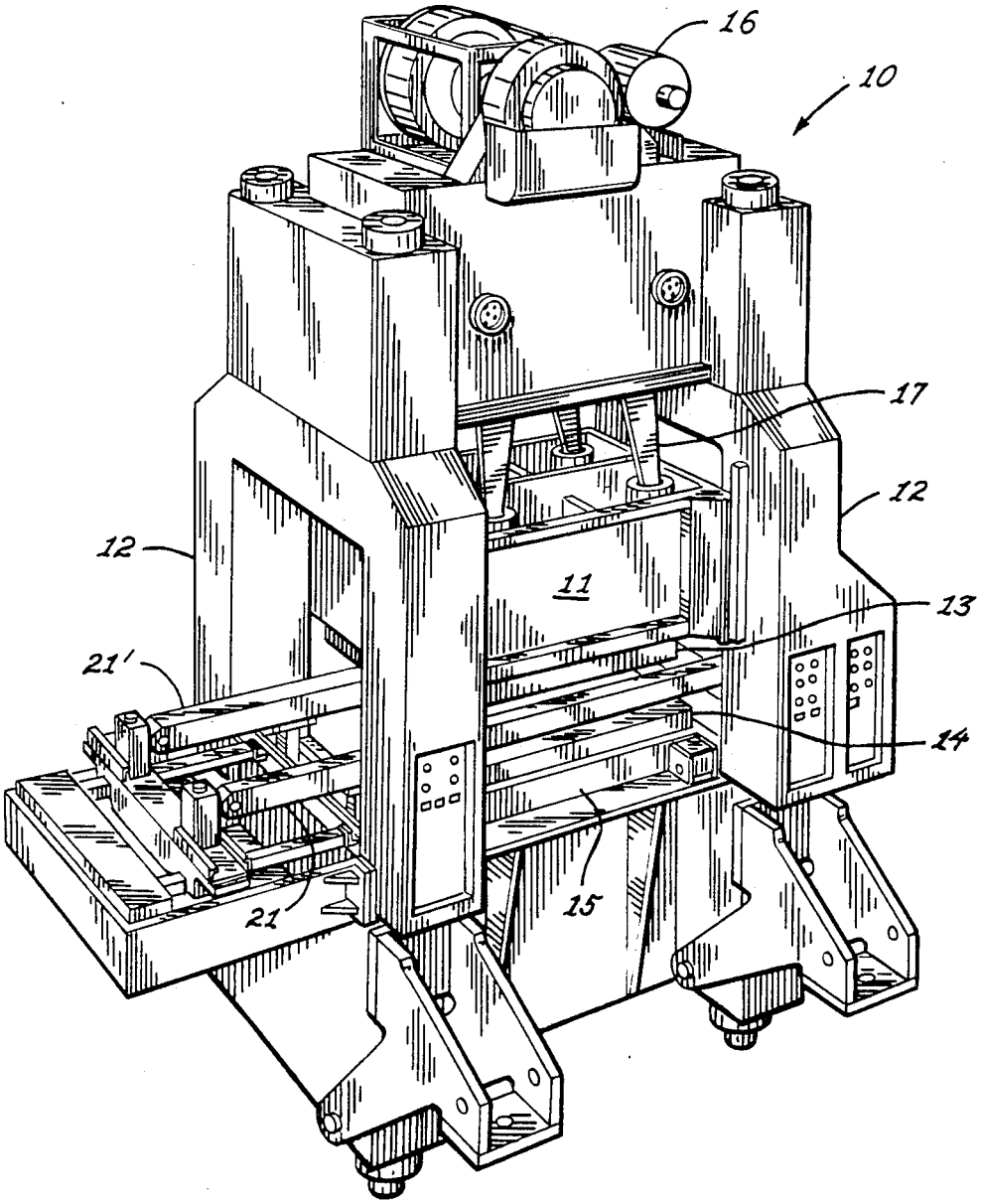
FIG. 1 is a perspective view of a transfer press with a servo-driven feed mechanism.

While the invention is susceptible to various modifications and alternative forms, specific embodiments thereof have been shown by way of example in the drawings and will be described in detail herein. It should be understood, however, that it is not intended to limit the invention to the particular forms disclosed, but, on the contrary, the intention is to cover all modifications, equivalents, and alternatives falling within the spirit and scope of the invention as defined by the appended claims.

Turning now to the drawings and referring first to FIG. 1, there is shown a power press 10 having a vertically movable slide 11 which is supported by a plurality of columns 12. In operation, the slide 11 carries an upper die 13, and is reciprocated vertically such that the upper die 13 and a stationary lower die 14 are alternately brought into and out of contact with a workpiece positioned between the two dies. The lower half of the die 14 is supported by a bolster 15 which can be moved transversely in and out of the press slide region.

The press 10 is powered from a large motor-driven flywheel on the crown 16. A clutch and brake interlock mechanism is mounted axially on the flywheel and is adapted to arrest the movement of the slide 11. The flywheel delivers power through a differential drive arrangement to each of the four corners of the slide 11 via a pitman 17. The shaft on which the eccentric is located normally has a rotary transducer positioned on one end to monitor the angular motion of the eccentric and hence the pitman and transduces it into an analog signal which is directly proportional to the angular position of the eccentric at any given point during the stroke.

A pair of transfer rails 21 and 21' extends longitudinally through the press 10 for transporting workpieces through successive workstations in the press. To accomplish this workpiece movement, the transfer rails 21, 21' can be moved longitudinally (the "X axis"), transversely (the "Y axis"), and vertically (the "Z axis")

by a tri-axial transfer drive. Conventional finger units (see FIGS. 4–8) are rigidly attached to the transfer rails 21, 21' for gripping the workpieces.

Figure 2:
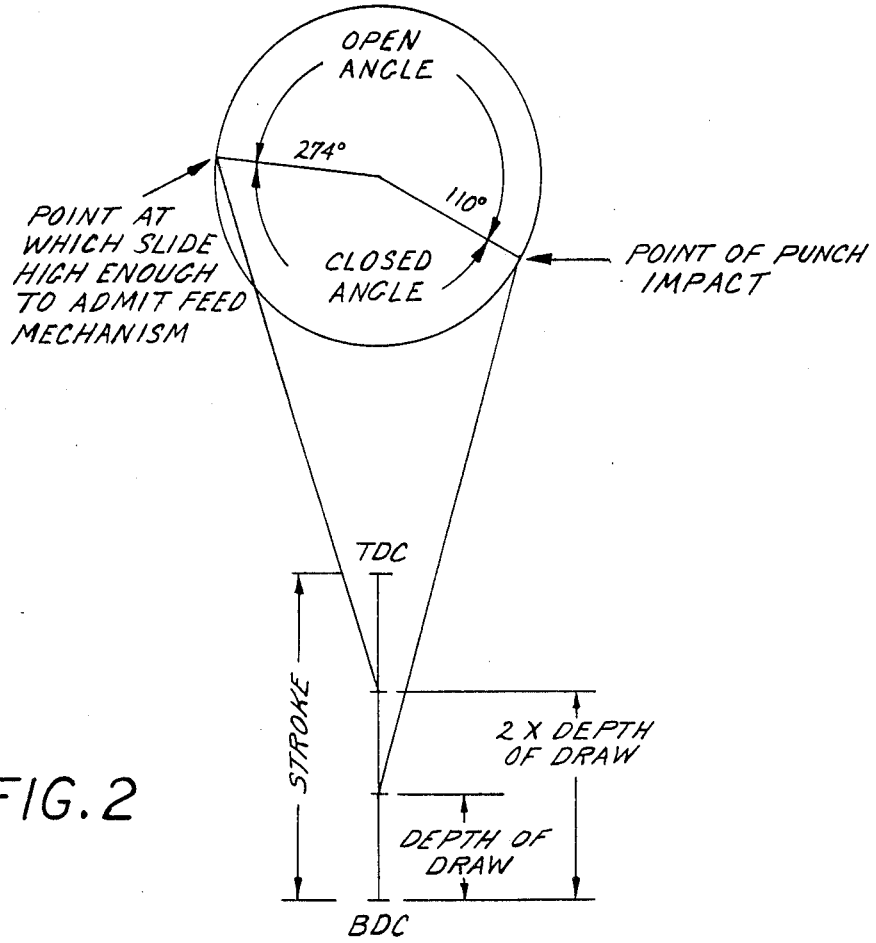
FIG. 2 is a diagrammatic illustration of the movement paths of the main press drive shaft and crank and the press slide.
Figure 3:
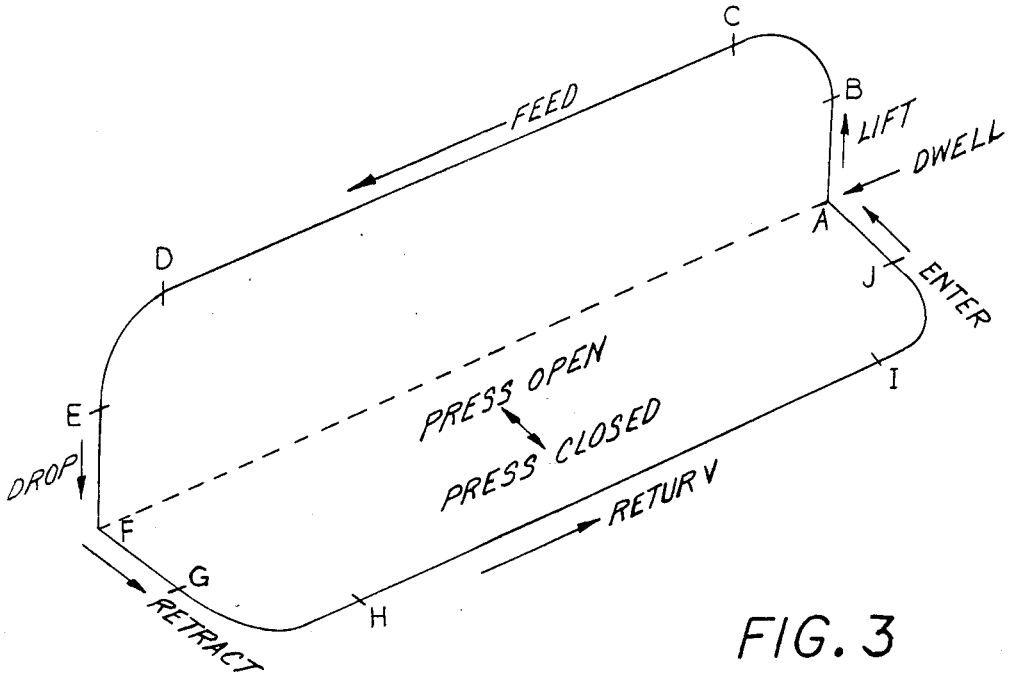
FIG. 3 is a diagrammatic illustration of the path of movement of the transfer feed mechanism.

FIGS. 2 and 3 illustrate one complete operating cycle of a hypothetical press for performing a drawing operation. The top portion of FIG. 2 represents the 360° rotation of the main press drive shaft and crank; the lower portion of FIG. 2 represents the corresponding vertical stroke of the press slide; and FIG. 3 represents the tri-axial movement of the feed mechanism. As indicated by the legends at the top of FIG. 2, the "open" portion of the press cycle begins at the point at which the slide has been raised far enough above its bottom-dead-center (BDC) position to admit the feed mechanism between the dies, and ends at the point at which the upper die (carried on the slide) engages the workpiece. In the illustrative example of FIG. 2, this "open" portion of the press cycle begins at a crank angle of 110° and ends at 274°. The "closed" portion of the press cycle is the remainder of the cycle, and in the illustrative example extends from the crank angle of 110° to 274°.

During the "closed" portion of the cycle, the press slide performs the desired work on the workpiece and then moves upwardly to an elevation sufficiently high to admit the feed mechanism between the workpiece and the die carried on the slide. In the illustrative example, the slide traverses the final 28% of its downstroke and about 55% of its upstroke during this "closed" portion of the cycle. During the final 28% of the downstroke, a relatively deep draw is produced in the workpiece; during the initial 28% of the upstroke the die carried by the press slide is withdrawn from the workpiece; and during the next 27% of the upstroke, the slide is raised far enough above the workpiece to admit the feed mechanism which transfers the workpieces between successive stations.

During the "open" portion of the cycle, the press slide traverses the final 45% of its upstroke and the initial 72% of its downstroke. It is during this interval that the feed mechanism picks up the workpieces and transfers them to the succeeding stations.

Before describing the physical structure of the feed mechanism, it will be helpful to refer to FIG. 3 which diagrammatically illustrates a typical transfer cycle. At the end of the "closed" portion of each press cycle, the feed mechanism moves the transfer finger units into the space between the open dies so as to bring the finger units into engagement with the respective workpieces. The feed mechanism dwells at this position, which is identified as position A in FIG. 3, for a brief interval to allow the finger units to securely grip the workpieces. The feed mechanism is then elevated from position A to position B to lift the workpieces off the lower dies, after which the mechanism is moved both vertically and longitudinally from position B to position C, and then longitudinally to transport the workpieces to the next stations. At position D the feed mechanism begins to descend toward the lower dies, continuing its longitudinal movement until it reaches position E, and then moving straight down to position F to lower the workpieces onto their respective succeeding lower dies. The feed mechanism again dwells at position F for a brief interval to allow the finger units to be disengaged from the workpieces, after which the mechanism is retracted transversely from position F to position G and then returned longitudinally through positions H and I to its original position J, ready for the next transfer cycle.

The diagrammatic illustration in FIG. 3 does not include a turnover step, but if the finger units are adapted to turn one or more workpieces while they are being transferred from one workstation to the next, the turnover step is carried out during the longitudinal movement from position C to position D.

Turning now to FIGS. 4–8, there is shown a feed mechanism for transferring workpieces sequentially along multiple workstations in the transfer press 10. In order to transfer the various workpieces to the desired positions and with the desired orientations at each of the multiple stations, the feed mechanism can be moved along any or all of the three different axes referred to as the longitudinal or X axis, the transverse or X axis, and the vertical or Z axis. As will be apparent from the ensuing description, the movement of the feed mechanism along each of these three axes is controlled by one or more independently controllable servo motors.

Figure 4:
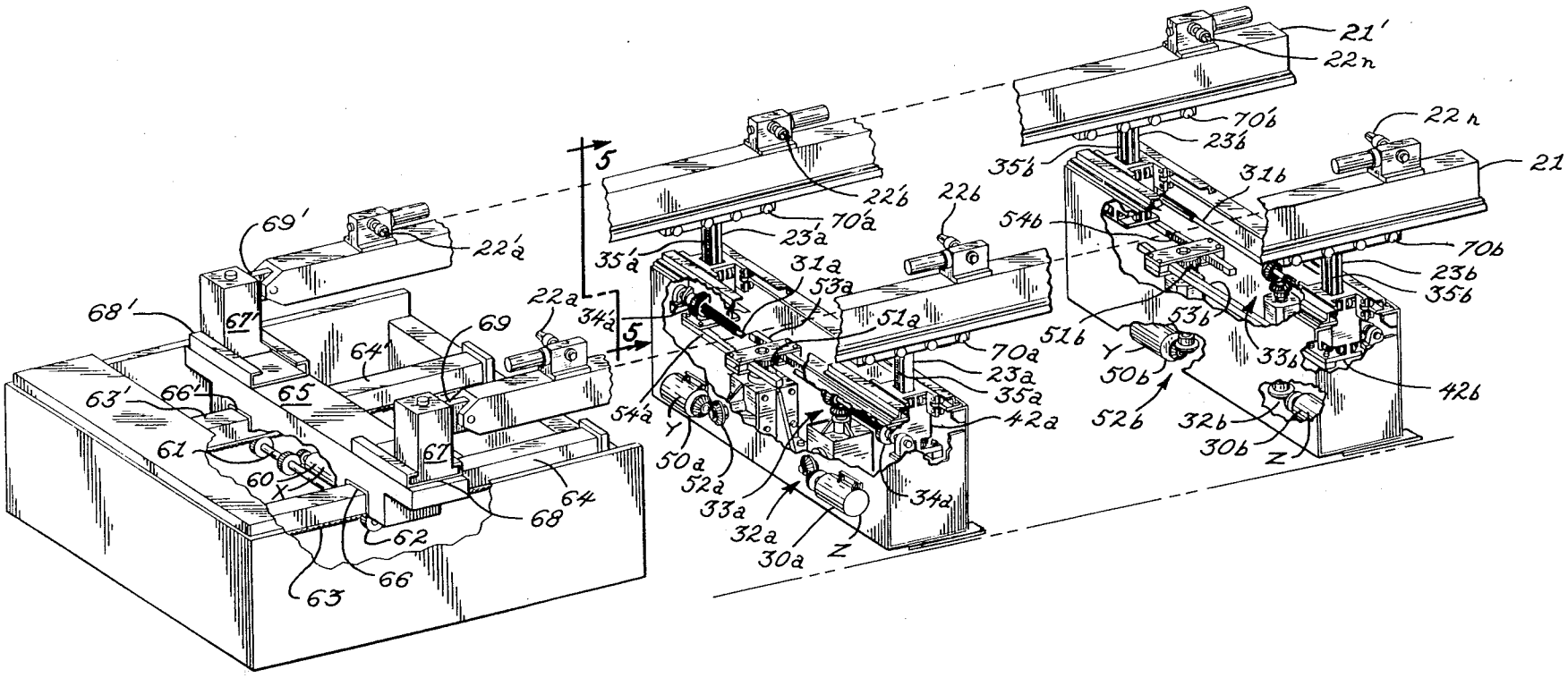
FIG. 4 is a fragmented perspective view of a transfer feed mechanism for use in the press of FIG. 1, and FIGS. 4A, 4B, and 4C are enlargements of the three fragments of the transfer feed mechanism shown in FIG. 4.

As can be seen most clearly in FIG. 4, the feed mechanism includes the aforementioned transfer rails 21 and 21' which extend along opposite sides of the multiple workstations. Each of these rails 21 and 21' carries a set of finger units *22a, 22b . . . 22n* and *22'a, 22'b . . . 22'n,* respectively, for gripping the workpieces at the respective workstations and transferring them to the next successive workstations. It will be appreciated that a press using a feed mechanism of this type normally has separate loading and unloading mechanisms situated at opposite ends of the press for supplying workpieces to the first pair of finger units *22a, 22'a* and removing the finished workpieces from the final pair of finger units *22n, 22'n.*

Because the entire mechanism associated with one of the transfer rails 21 and 21' is identical to the mechanism associated with the other rail, the detailed description to follow will be directed only to the mechanism associated with one of the rails, and corresponding parts associated with the two rails will be identified by identical reference numerals with the addition of a distinguishing prime for those parts associated with the rail 21'.

Figure 4A:
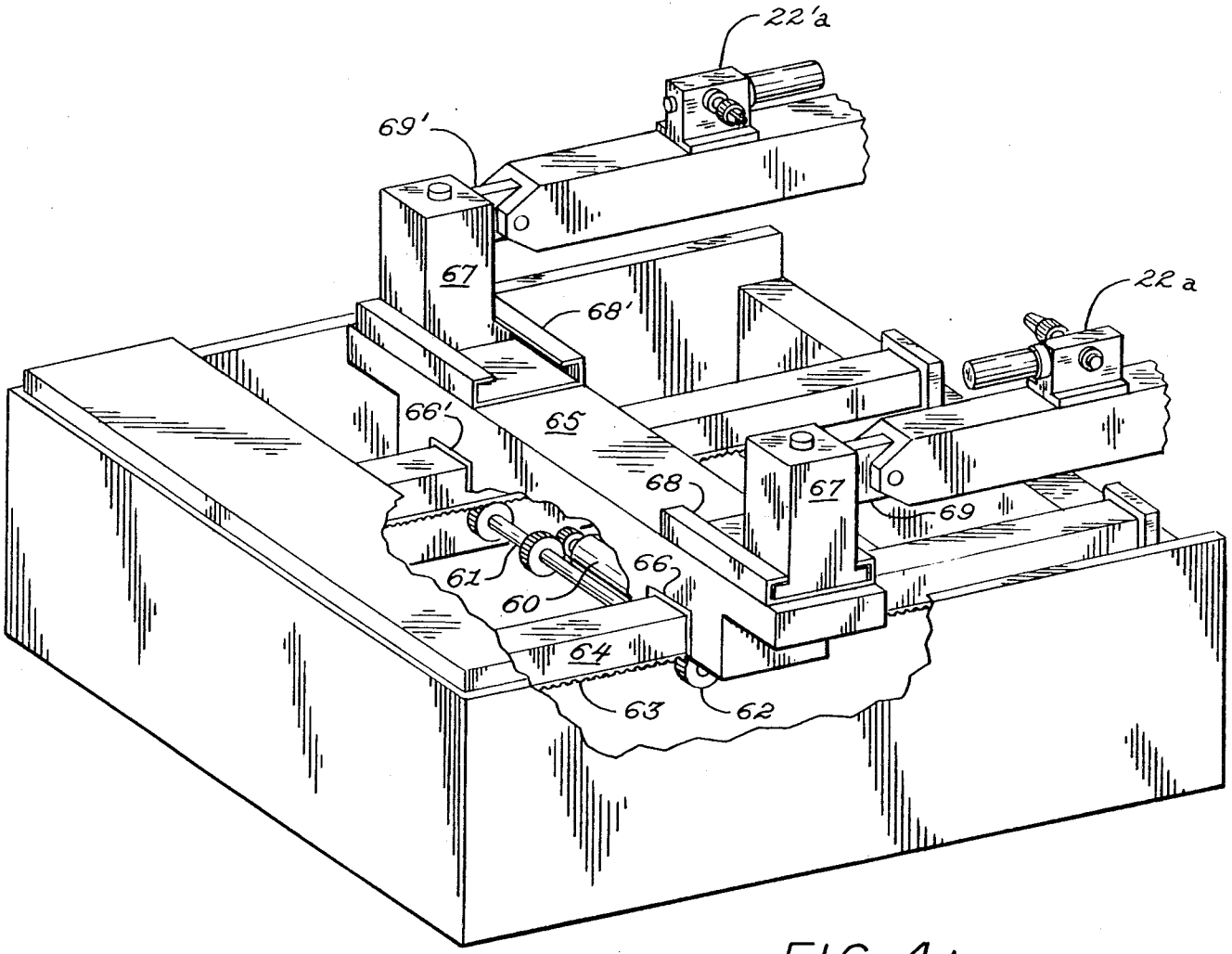
Figure 4B:
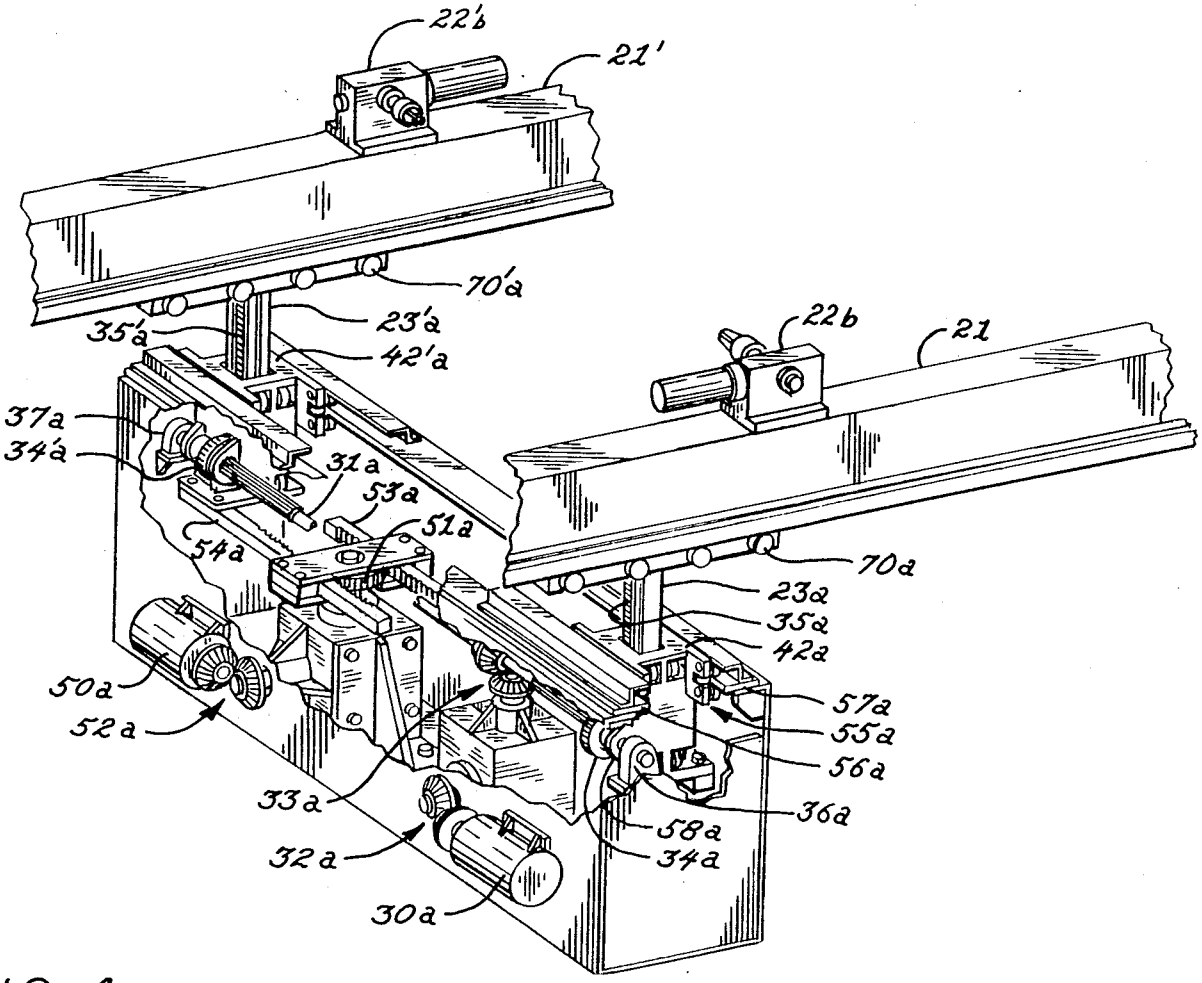
Figure 4C:
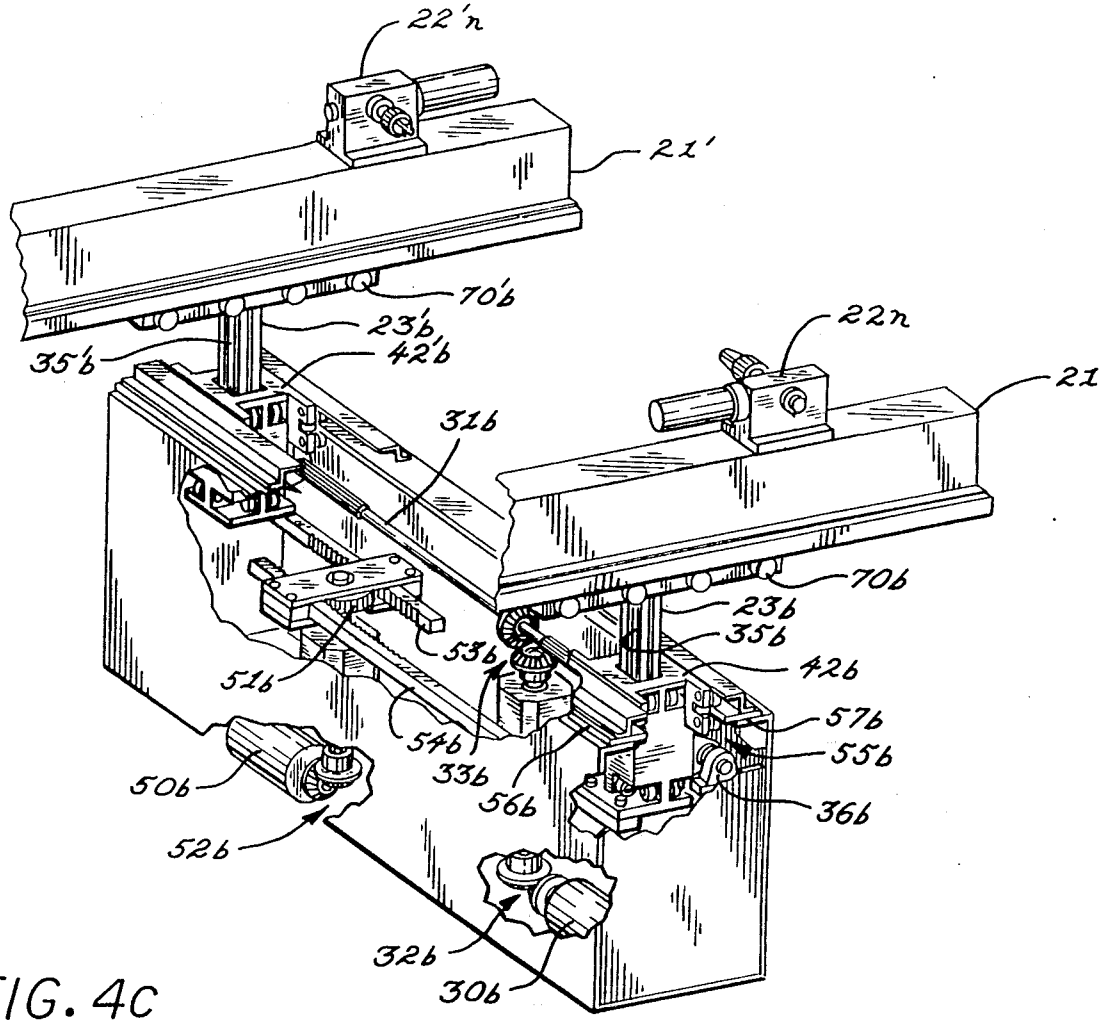
Figure 5:
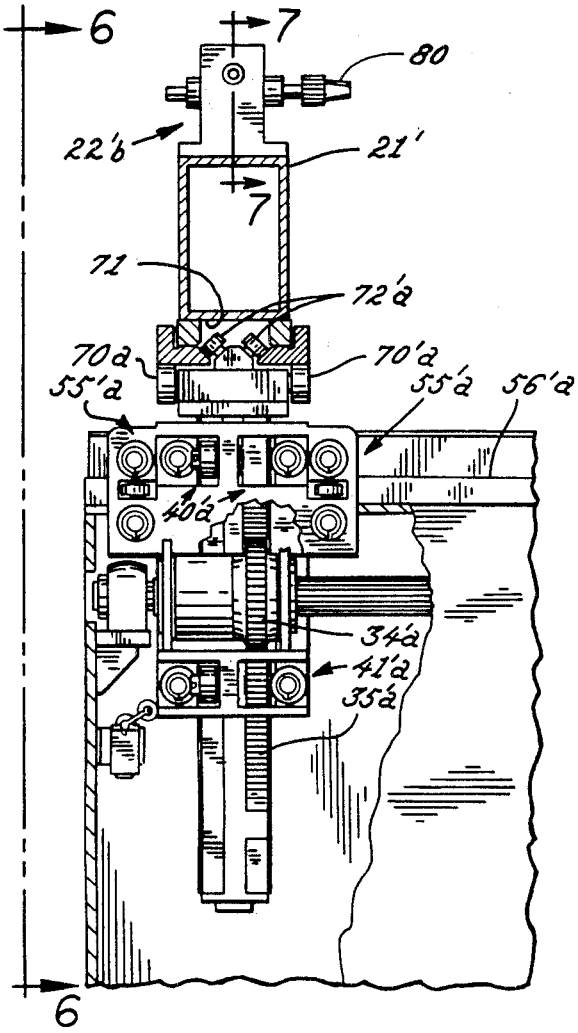
FIG. 5 is a section taken generally along line 5—5 in FIG. 4, on an enlarged scale.
Figure 6:
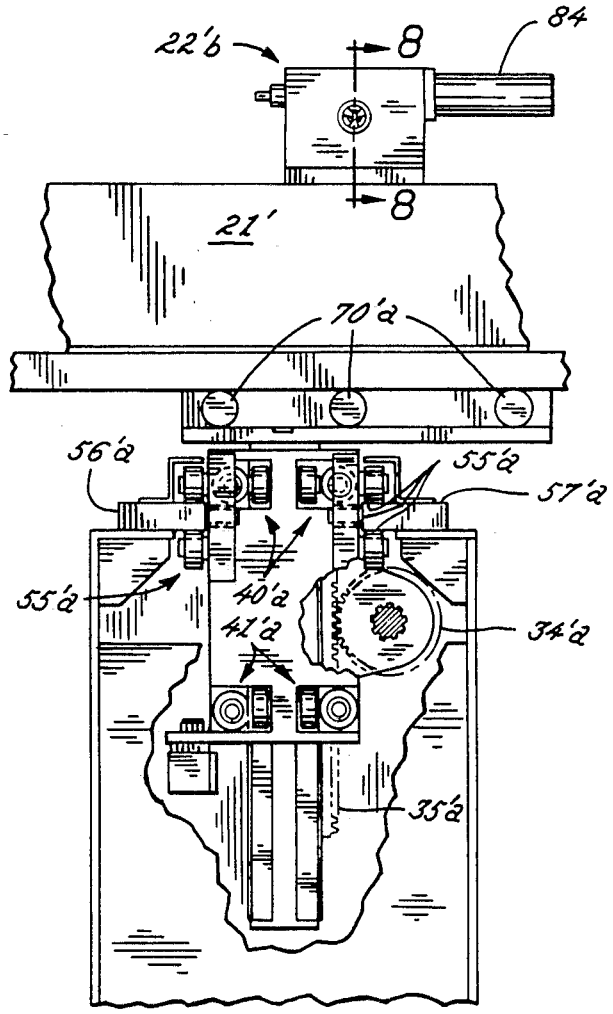
FIG. 6 is a side elevation taken generally along line 6—6 in FIG. 5.

The illustrative feed mechanism supports the rail 21 on a pair of vertically movable columns *23a* and *23b.* For vertical movement of the rail 21, a pair of Z-axis servo motors *30a* and *30b* drive elongated shafts *31a* and *31b* via successive bevel gear pairs *32a, 33a* and *32b, 33b,* respectively. The two shafts *31a* and *31b* carry respective pinions *34a* and *34b* which mesh with cooperating vertical racks *35a* and *35b* fastened to the columns *23a* and *23b,* respectively. As can be seen most clearly in FIG. 4B, the ends of the shafts *31a* and *31b* are journaled in stationary bearing blocks *36a, 37a* and *36b, 37b* on the base of the feed mechanism.

Each of the columns *23a* and *23b* is mounted for vertical sliding movement within two sets of six roller bearings *40a, 41a* and *40b, 41b* (see FIGS. 5 and 6) mounted on housings *42a* and *42b,* respectively. The roller bearings *40a, 41a* and *40b, 41b* ride on hardened steel tracks on the vertical side walls of the columns *23a* and *23b,* thereby guiding the columns along straight vertical paths for lifting and lowering the rail 21. The vertical position of the rail 21 at any given time, of course, is determined by the positions of the racks *35a* and *35b* as controlled by the Z-axis drive motors *30a* and *30b.* The two Z-axis drive motors *30a* and *30b* are driven in synchronism with each other so that the rail 21 is always maintained in a perfectly horizontal position.

Transverse movement of the rails 21 and 21' is effected and controlled by a pair of Y-axis servo motors 50*a* and 50*b* mounted on the stationary base of the feed mechanism. These two drive motors 50*a* and 50*b* drive corresponding pinions 51*a* and 51*b* via respective pairs of bevel gears 52*a* and 52*b*, and the pinions 51*a* and 51*b* in turn mesh with parallel pairs of cooperating horizontal racks 53*a*, 54*a* and 53*b*, 54*b* attached to the respective housings 42*a*, 42'*a* and 42*b*, 42'*b*. Thus, reciprocating movement of the racks 53*a* and 53*b* moves the housings 42*a* and 42*b*, and thus the columns 23*a* and 23*b* and the rail 21 mounted thereon, back and forth in the transverse (Y-axis) direction. To accommodate this Y-axis movement, each of the housings 42*a*, 42*b* is supported and guided by four roller bearing triplets, 55*a* and 55*b* respectively, riding on two pairs of stationary transverse rails 56*a*, 57*a* and 56*b*, 57*b* (see FIGS. 4B, 4C, 5 and 6).

During the traversing movement of the housings 42*a* and 42*b* along the transverse rails 56*a*, 57*a* and 56*b*, 57*b*, the vertical columns 23*a*, 23*b* and the racks 35*a*, 35*b* mounted thereon, as well as the pinions 34*a*, 34*b* meshing therewith, are carried along with the two housings. This traversing movement of the pinions 34*a* and 34*b* is effected by respective pairs of bosses 58*a* and 58*b* projecting from the housings 42*a* and 42*b* on opposite sides of the pinions. To accommodate this Y-axis movement of the Z-axis drive pinions 34*a*, 34*b*, the end portions of the shafts 31*a* and 31*b* are splined so that the pinions 34*a*, 34*b* can slide back and forth along the splined portions of the shafts 31*a*, 31*b* while being simultaneously driven by those shafts. The shafts themselves remain stationary except for their rotational movement, and the bevel gears 33*a*, 33*b* which drive the shafts are located between the splined portions of the shafts so that they do not interfere with the Y-axis movement of the Z-axis drive pinions 34*a*, 34*b*.

For longitudinal movement of the transfer rail 21, an X-axis servo motor 60 (see FIG. 4A) drives a transverse shaft 61 carrying a pinion 62 meshing with a stationary rack 63 formed on the bottom of a rail 64 fastened to the base of the feed mechanism. The drive motor 60 is fastened to the bottom of a transverse beam 65 supported for smooth sliding X-axis movement by a pair of linear bearings 66 and 66' sliding on the top and side surfaces of the rails 64 and 64'. The beam 65 is also attached to the ends of the two rails 21 and 21' by a pair of slide blocks 67 and 67' captured in a pair of transverse gibs 68 and 68'. These slide blocks 67, 67' and gibs 68, 68' permit the rails 21, 21' to be moved transversely (in the Y-axis direction) along the beam 65 simultaneously with longitudinal (X-axis) movement of the rails and the beam 65. Vertical movement of the rails 21 and 21' is also permitted by pivoting links 69 and 69' between the respective slide blocks 67, 67' and the rails 21, 21'.

To permit the rail 21 to move longitudinally relative to the columns 23*a* and 23*b*, even while the columns are moving the rails vertically and/or laterally, the rails 21, 21' ride on parallel sets of roller bearings 70*a* and 70*b* carried on the tops of the respective columns 23*a* and 23*b*. To hold the rails 21, 21' captive on the columns 23*a* and 23*b* for vertical and/or lateral movement therewith, the underside of each rail forms a longitudinal channel 71 which receives a set of canted roller bearings 72*a* and 72*b* which are also carried on the tops of the respective columns 23*a* and 23*b*. These roller bearings 72*a* and 72*b* ride on beveled surfaces within the channel 71, thereby holding the rail 21 captive on the columns while permitting longitudinal movement of the rail relative to the columns.

Figure 7:
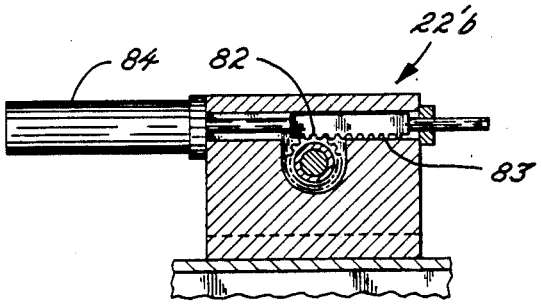
FIG. 7 is a section taken generally along line 7—7 in FIG. 5, on an enlarged scale.
Figure 8:
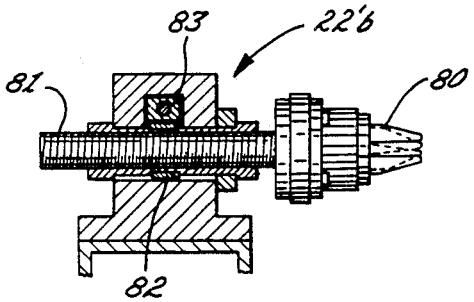
FIG. 8 is a section taken generally along line 8—8 in FIG. 6, on an enlarged scale.

To permit the workpieces to be turned over while they are being transferred from one work station to the next, each of the finger units 22*a* . . . 22*n* and 22'*a* . . . 22'*n* has the construction illustrated in FIGS. 7 and 8 for the finger unit 22'*b*. Thus, the grippers 80 of the finger unit are mounted on a shaft 81 carrying a pinion 82 which meshes with a rack 83. The rack 83 can be driven back and forth in the X-axis direction by means of an air cylinder 84, thereby rotating the gripping fingers 80 about the Y-axis to turn over the workpiece carried by the fingers.

In accordance with one important aspect of the present invention, the press drive shaft is driven at a first, relatively fast angular velocity during the "closed" portion of each cycle of reciprocating movement of the press slide, and is then driven at a second angular velocity slower than the first angular velocity, during the "open" portion of each cycle of reciprocating movement of the press slide; the second angular velocity is sufficiently slow to allow the automatic feed mechanism to execute its transfer cycle during the "open" portion of each cycle.

In the method of this invention, the press drive shaft is decelerated at the beginning of the "open" portion of the press cycle, preferably as soon as the press slide has been raised to an elevation that permits the feed mechanism to enter the space between the upper and lower dies to remove the workpieces from that space. The drive shaft then continues to be driven at the reduced velocity throughout the "open" portion of the cycle, i.e., until the upper die is about to impact the next workpiece. Thus, the press can have a short stroke with a low impact velocity while at the same time allowing adequate time for the transfer cycle of even the most complex feed mechanism. For example, in the example to be described below, the press stroke is only half as long as the stroke used in current presses for performing the same work (20 inches instead of 40 inches). In general, each inch of stroke length requires an additional three inches of press height, so a 20-inch reduction in stroke length permits a 60 inch reduction in the height of the press.

Furthermore, the impact velocity can be reduced below the lowest levels that are feasible in current long-stroke presses, and this lower impact velocity translates into reduced noise levels, reduced die wear rates, and improved part quality. The clutch and brake can be smaller as a result of the improved mechanical advantage of the shorter stroke, which means they have a lower cost, require less space, and generally present fewer maintenance problems. The lower inertia of the smaller clutch also provides the benefit of reduced energy consumption in comparison to the alternative long stroke system when that system incorporates a "slow down" to reduce the inherent high impact velocity.

Moreover, the relatively slow velocity of the press during the entire "open" portion of the cycle is a safer mode of operation because the press can be stopped more quickly, and with less damage, in the event of a fault. Most faults occur during the "open" portion of the press cycle when the dies are open so that obstructions, such as a misaligned workpiece or a faulty feed mechanism, can become lodged between the dies. When the dies are closed or in the process of opening, there is little that can go wrong; and these are the only times when the press drive shaft is driven at the higher velocity in the method of this invention.

The following specific example will illustrate how to practice this invention using a conventional eddy current press drive system in a 3200-ton transfer press having the following characteristics:

| | |
|---|---|
| CRANK RADIUS: | 9.00 IN. |
| PITTMAN LENGTH: | 130.00 IN. |
| BELT RATIO: (MOTOR TO CLUTCH) | 4.000 to 1 |
| GEAR RATIO: (OUTPUT SHAFT TO CRANK) | 20.000 to 1 |
| SLIDE WEIGHT: | 200 TONS |
| MIN. COUNTERBALANCE FORCE: | 178.9 TONS |
| MAX. COUNTERBALANCE FORCE: | 221.1 TONS |
| ROTATING PARTS INERTIA REFL. TO DRIVE SHAFT: | 2500 LB-FT$^2$ |
| FRICTION TORQUE INERTIA REFL. TO DRIVE SHAFT: | 0 LB-FT |
| AIR BRAKE TORQUE INERTIA REFL. TO DRIVE SHAFT: | 0 LB-FT |
| PRESS IS GEARED FOR: | 22.50 SPM |

Operation of this press was simulated for the following loads:

| X (IN. FROM BDC) | LOAD (TONS) |
|---|---|
| 18.000 | 0 |
| 5.100 | 0 |
| 5.000 | 200 |

-continued

| X (IN. FROM BDC) | LOAD (TONS) |
|---|---|
| 4.000 | 300 |
| 3.000 | 400 |
| 2.000 | 500 |
| 1.000 | 2000 |
| 0.500 | 3200 |
| 0.010 | 3200 |
| 0.000 | 0 |

using an "eddy current" adjustable speed press drive system with the following characteristics:

| | | | |
|---|---|---|---|
| "DYNAMATIC" PRESS DRIVE MODEL: | | | 49-63 RUN |
| PARAMETERS: | | | |
| CLUTCH DESCR.: | | CES 49-63 | STRKL: 5 |
| MAX. CLUTCH TORQUE: | | 95,000 LBS-FT | ICOND: 0.000 |
| MAX. BRAKE TORQUE: | | 475,000 LBS-FT$^2$ | HPLL: 16.000 |
| INPUT INERTIA: | | 140,000 LBS-FT$^2$ | DELT: 0.010 |
| OUTPUT: | | 10,000 LBS-FT | PRINTV: 0.050 |
| MOTOR ID: | NEMA D | | |
| HP: | 800 | | |
| RPM: | 1800 | | |
| SLIP: | 8% | | |
| INERTIA: | 350 LBS-FT$^2$ | | |

The simulated set points for the crank velocity were 12.5 SPM for 0° to 100°; 20.0 SPM from 110° to 274°; and 12.5 SPM from 274° to 360°.

a computer-simulated operation of the above press under the above conditions yielded the following results:

| TIME | MOTOR | | | FLY WHL | CLUTCH | | | BRAKE | |
|---|---|---|---|---|---|---|---|---|---|
| SEC | RPM | TQ | HP | RPM | RPM | TQ | DISS HP | TQ | DISS HP |
| CONTROL MODE - CRANK VELOCITY DRIVE TYPE - TOP OPERATING MODE - CONTINUOUS STROKING | | | | | | | | | |
| 0.000 | 1693 | 2095 | 676 | 423 | 247 | 60 | 2 | | 0 |
| 0.050 | 1697 | 2038 | 659 | 424 | 248 | 20 | 1 | | 0 |
| 0.100 | 1700 | 1982 | 642 | 425 | 248 | 7 | 0 | | 0 |
| 0.150 | 1704 | 1926 | 625 | 426 | 248 | 2 | 0 | | 0 |
| 0.200 | 1707 | 1872 | 609 | 427 | 248 | 1 | 0 | | 0 |
| 0.250 | 1710 | 1818 | 592 | 427 | 248 | | 0 | | 0 |
| 0.300 | 1713 | 1766 | 576 | 428 | 249 | | 0 | | 0 |
| 0.350 | 1716 | 1714 | 560 | 429 | 249 | | 0 | | 0 |
| 0.400 | 1719 | 1663 | 545 | 430 | 250 | | 0 | | 0 |
| 0.450 | 1722 | 1614 | 529 | 430 | 250 | | 0 | | 0 |
| 0.500 | 1724 | 1565 | 514 | 431 | 251 | | 0 | | 0 |
| 0.550 | 1727 | 1518 | 499 | 432 | 251 | | 0 | | 0 |
| 0.600 | 1729 | 1471 | 485 | 432 | 252 | | 0 | | 0 |
| 0.650 | 1732 | 1426 | 470 | 433 | 252 | | 0 | | 0 |
| 0.700 | 1734 | 1382 | 456 | 434 | 253 | | 0 | −554 | −26 |
| 0.750 | 1737 | 1338 | 443 | 434 | 253 | | 0 | −494 | −23 |
| 0.800 | 1739 | 1296 | 429 | 435 | 253 | | 0 | −401 | −18 |
| 0.850 | 1741 | 1255 | 416 | 435 | 253 | | 0 | −410 | −19 |
| 0.900 | 1743 | 1214 | 403 | 436 | 253 | | 0 | −364 | −17 |
| 0.950 | 1745 | 1175 | 391 | 436 | 253 | | 0 | −317 | −14 |
| 1.000 | 1747 | 1137 | 378 | 437 | 253 | | 0 | −269 | −12 |
| 1.050 | 1749 | 1099 | 366 | 437 | 253 | | 0 | −213 | −9 |
| 1.100 | 1751 | 1063 | 355 | 438 | 253 | | 0 | −154 | −6 |
| 1.150 | 1753 | 1028 | 343 | 438 | 253 | | 0 | −92 | −3 |
| 1.200 | 1754 | 994 | 332 | 439 | 252 | | 0 | −34 | −1 |
| 1.250 | 1756 | 960 | 321 | 439 | 252 | | 0 | −11 | 0 |
| 1.300 | 1758 | 928 | 311 | 439 | 252 | | 0 | −3 | 0 |
| 1.350 | 1759 | 896 | 300 | 440 | 252 | | 0 | | 0 |
| 1.400 | 1761 | 866 | 290 | 440 | 252 | | 0 | | 0 |
| 1.450 | 1762 | 836 | 281 | 441 | 252 | | 0 | | 0 |
| 1.500 | 1763 | 812 | 273 | 441 | 252 | 3707 | 433 | | 0 |
| 1.550 | 1758 | 912 | 306 | 440 | 269 | 38692 | 1254 | | 0 |
| LOAD ZONE ENTERED - START FINE PRINT INTERVAL | | | | | | | | | |
| 1.570 | 1752 | 1045 | 349 | 438 | 290 | 53484 | 1510 | | 0 |
| 1.580 | 1748 | 1127 | 375 | 437 | 301 | 58775 | 1521 | | 0 |
| 1.590 | 1743 | 1217 | 404 | 436 | 311 | 61925 | 1465 | | 0 |

-continued

| | | | | | | | | | |
|---|---|---|---|---|---|---|---|---|---|
| 1.600 | 1738 | 1309 | 433 | 435 | 323 | 63609 | 1356 | | 0 |
| 1.610 | 1733 | 1402 | 463 | 433 | 334 | 64322 | 1217 | | 0 |
| 1.620 | 1728 | 1494 | 492 | 432 | 345 | 62000 | 1024 | | 0 |
| 1.630 | 1723 | 1580 | 519 | 431 | 356 | 57867 | 826 | | 0 |
| 1.640 | 1719 | 1658 | 543 | 430 | 365 | 52741 | 647 | | 0 |
| 1.650 | 1715 | 1727 | 564 | 429 | 373 | 46654 | 492 | | 0 |
| 1.660 | 1712 | 1785 | 582 | 428 | 380 | 40133 | 368 | | 0 |
| 1.670 | 1709 | 1833 | 597 | 427 | 385 | 33144 | 269 | | 0 |
| 1.680 | 1707 | 1871 | 608 | 427 | 388 | 27063 | 202 | | 0 |
| 1.690 | 1705 | 1899 | 617 | 426 | 389 | 22283 | 159 | | 0 |
| 1.700 | 1704 | 1920 | 623 | 426 | 389 | 18311 | 129 | | 0 |
| 1.710 | 1703 | 1935 | 628 | 426 | 388 | 15907 | 114 | | 0 |
| 1.720 | 1702 | 1946 | 631 | 426 | 386 | 14786 | 111 | | 0 |
| 1.730 | 1702 | 1956 | 634 | 425 | 384 | 14750 | 115 | | 0 |
| 1.740 | 1701 | 1966 | 637 | 425 | 382 | 15560 | 128 | | 0 |
| 1.760 | 1700 | 1990 | 644 | 425 | 379 | 18668 | 165 | | 0 |
| 1.770 | 1699 | 2005 | 649 | 425 | 377 | 20456 | 185 | | 0 |
| 1.780 | 1698 | 2022 | 654 | 424 | 376 | 22125 | 202 | | 0 |
| 1.790 | 1697 | 2042 | 660 | 424 | 376 | 23531 | 216 | | 0 |
| 1.800 | 1695 | 2063 | 666 | 424 | 376 | 24586 | 225 | | 0 |
| 1.810 | 1694 | 2085 | 673 | 423 | 375 | 26135 | 242 | | 0 |
| 1.820 | 1692 | 2110 | 680 | 423 | 373 | 28483 | 273 | | 0 |
| 1.830 | 1691 | 2137 | 688 | 423 | 370 | 31927 | 322 | | 0 |
| 1.840 | 1689 | 2169 | 698 | 422 | 366 | 36412 | 390 | | 0 |
| 1.850 | 1686 | 2206 | 709 | 422 | 362 | 40890 | 463 | | 0 |
| 1.860 | 1684 | 2249 | 721 | 421 | 358 | 45520 | 544 | | 0 |
| 1.870 | 1681 | 2297 | 735 | 420 | 354 | 49170 | 615 | | 0 |
| 1.880 | 1677 | 2350 | 751 | 419 | 351 | 52750 | 688 | | 0 |
| 1.890 | 1674 | 2406 | 767 | 418 | 347 | 55656 | 753 | | 0 |
| 1.900 | 1670 | 2464 | 784 | 417 | 344 | 58358 | 816 | | 0 |
| 1.910 | 1666 | 2525 | 801 | 416 | 341 | 60883 | 876 | | 0 |
| 1.920 | 1661 | 2588 | 819 | 415 | 337 | 63613 | 943 | | 0 |
| 1.930 | 1657 | 2653 | 837 | 414 | 334 | 65606 | 1001 | | 0 |
| 1.940 | 1652 | 2719 | 856 | 413 | 331 | 66232 | 1040 | | 0 |
| 1.950 | 1647 | 2784 | 874 | 412 | 327 | 66913 | 1083 | | 0 |
| 1.960 | 1643 | 2849 | 891 | 411 | 323 | 67604 | 1126 | | 0 |
| 1.970 | 1638 | 2913 | 909 | 409 | 320 | 68266 | 1169 | | 0 |
| 1.980 | 1633 | 2977 | 926 | 408 | 316 | 68866 | 1208 | | 0 |
| 1.990 | 1628 | 3040 | 943 | 407 | 313 | 69329 | 1239 | | 0 |
| 2.000 | 1624 | 3102 | 959 | 406 | 311 | 69495 | 1250 | | 0 |
| 2.010 | 1619 | 3163 | 975 | 405 | 311 | 69387 | 1242 | | 0 |
| 2.020 | 1614 | 3223 | 991 | 403 | 311 | 69021 | 1218 | | 0 |
| 2.030 | 1609 | 3281 | 1006 | 402 | 312 | 68417 | 1178 | | 0 |
| 2.040 | 1604 | 3337 | 1020 | 401 | 314 | 67588 | 1124 | | 0 |
| 2.050 | 1600 | 3391 | 1033 | 400 | 316 | 66550 | 1058 | | 0 |
| 2.060 | 1595 | 3443 | 1046 | 399 | 320 | 65226 | 981 | | 0 |
| 2.070 | 1591 | 3493 | 1059 | 398 | 324 | 63365 | 890 | | 0 |
| 2.080 | 1587 | 3541 | 1070 | 397 | 329 | 61312 | 793 | | 0 |
| 2.090 | 1583 | 3585 | 1081 | 396 | 334 | 59079 | 694 | | 0 |
| 2.100 | 1579 | 3627 | 1091 | 395 | 340 | 55853 | 584 | | 0 |
| 2.110 | 1576 | 3665 | 1100 | 394 | 346 | 52233 | 477 | | 0 |
| 2.120 | 1572 | 3699 | 1108 | 393 | 352 | 48109 | 374 | | 0 |
| 2.130 | 1570 | 3729 | 1115 | 392 | 359 | 43662 | 280 | | 0 |
| 2.140 | 1567 | 3754 | 1121 | 392 | 365 | 38349 | 194 | | 0 |
| 2.150 | 1565 | 3775 | 1125 | 391 | 372 | 31342 | 117 | | 0 |
| 2.160 | 1564 | 3789 | 1129 | 391 | 379 | 22850 | 53 | | 0 |
| LOAD ZONE COMPLETE - RESUME COARSE PRINT INTERVAL | | | | | | | | | |
| 2.200 | 1565 | 3776 | 1126 | 391 | 390 | 1909 | 1 | | 0 |
| 2.250 | 1571 | 3714 | 1111 | 393 | 391 | 724 | 0 | | 0 |
| 2.300 | 1577 | 3650 | 1096 | 394 | 392 | 573 | 0 | | 0 |
| 2.350 | 1583 | 3586 | 1081 | 396 | 393 | 491 | 0 | | 0 |
| 2.400 | 1589 | 3521 | 1065 | 397 | 393 | 465 | 0 | | 0 |
| 2.450 | 1594 | 3456 | 1049 | 399 | 394 | 484 | 0 | | 0 |
| 2.500 | 1600 | 3390 | 1033 | 400 | 395 | 470 | 0 | | 0 |
| 2.550 | 1605 | 3325 | 1017 | 401 | 395 | 432 | 1 | | 0 |
| 2.600 | 1611 | 3260 | 1000 | 403 | 396 | 383 | 1 | | 0 |
| 2.650 | 1616 | 3194 | 983 | 404 | 396 | 328 | 0 | | 0 |
| 2.700 | 1621 | 3129 | 966 | 405 | 396 | 268 | 0 | | 0 |
| 2.750 | 1627 | 3063 | 949 | 407 | 397 | 208 | 0 | | 0 |
| 2.800 | 1632 | 2997 | 932 | 408 | 397 | 145 | 0 | | 0 |
| 2.850 | 1637 | 2932 | 914 | 409 | 397 | 92 | 0 | | 0 |
| 2.900 | 1641 | 2866 | 896 | 410 | 397 | 51 | 0 | | 0 |
| 2.950 | 1646 | 2801 | 878 | 412 | 397 | 21 | 0 | | 0 |
| 3.000 | 1651 | 2735 | 860 | 413 | 378 | 11 | 0 | −75326 | −5421 |
| 3.050 | 1655 | 2672 | 842 | 414 | 211 | 2034 | 78 | −99850 | −4016 |
| 3.100 | 1656 | 2668 | 841 | 414 | 160 | 30606 | 1479 | −16021 | −487 |
| 3.150 | 1640 | 2893 | 903 | 410 | 206 | 65867 | 2562 | −5534 | −216 |
| 3.200 | 1624 | 3094 | 957 | 406 | 257 | 18529 | 525 | −8473 | −414 |
| 3.350 | 1634 | 2970 | 924 | 408 | 245 | 1818 | 57 | −1164 | −53 |
| 3.400 | 1638 | 2914 | 909 | 409 | 245 | 1742 | 54 | −381 | −17 |
| 3.450 | 1642 | 2857 | 894 | 411 | 246 | 1212 | 38 | −124 | −5 |
| 3.500 | 1647 | 2797 | 877 | 412 | 247 | 724 | 23 | −40 | −1 |

-continued

| | | | | | | | | | |
|---|---|---|---|---|---|---|---|---|---|
| 3.550 | 1651 | 2735 | 860 | 413 | 247 | 476 | 15 | −12 | 0 |
| 3.600 | 1655 | 2673 | 843 | 414 | 247 | 417 | 13 | −3 | 0 |
| 3.650 | 1660 | 2612 | 826 | 415 | 247 | 433 | 14 | | 0 |
| 3.700 | 1664 | 2551 | 808 | 416 | 247 | 447 | 14 | | 0 |
| 3.750 | 1668 | 2490 | 791 | 417 | 247 | 436 | 14 | | 0 |
| 3.800 | 1672 | 2430 | 774 | 418 | 247 | 403 | 13 | | 0 |
| 3.850 | 1676 | 2371 | 757 | 419 | 247 | 358 | 12 | | 0 |
| 3.900 | 1680 | 2312 | 740 | 420 | 247 | 308 | 10 | | 0 |
| 3.950 | 1683 | 2254 | 723 | 421 | 247 | 254 | 8 | | 0 |
| 4.000 | 1687 | 2196 | 706 | 422 | 247 | 198 | 7 | | 0 |
| 4.050 | 1691 | 2138 | 689 | 423 | 247 | 139 | 5 | | 0 |
| 4.100 | 1694 | 2081 | 672 | 424 | 247 | 78 | 3 | | 0 |

| | | | PRESS | | | LOAD | |
|---|---|---|---|---|---|---|---|
| TIME SEC | REF SPM | ACT. SPM | SLIDE VEL | SLIDE POSIT | CRANK ANGLE | TONS | TQ |
| | | | CONTROL MODE - CRANK VELOCITY<br>DRIVE TYPE - TOP<br>OPERATING MODE - CONTINUOUS STROKING | | | | |
| 0.000 | 12 | 12.4 | 0.0 | 18.00 | 0 | 0 | |
| 0.050 | 12 | 12.4 | 3.5 | 17.99 | 4 | 0 | 62 |
| 0.100 | 12 | 12.4 | 7.0 | 17.93 | 7 | 0 | 124 |
| 0.150 | 12 | 12.4 | 10.5 | 17.85 | 11 | 0 | 183 |
| 0.200 | 12 | 12.4 | 14.0 | 17.72 | 15 | 0 | 239 |
| 0.250 | 12 | 12.4 | 17.4 | 17.57 | 19 | 0 | 290 |
| 0.300 | 12 | 12.4 | 20.8 | 17.38 | 22 | 0 | 337 |
| 0.350 | 12 | 12.5 | 24.2 | 17.15 | 26 | 0 | 377 |
| 0.400 | 12 | 12.5 | 27.5 | 16.89 | 30 | 0 | 411 |
| 0.450 | 12 | 12.5 | 30.7 | 16.60 | 34 | 0 | 438 |
| 0.500 | 12 | 12.5 | 33.8 | 16.28 | 37 | 0 | 457 |
| 0.550 | 12 | 12.6 | 36.8 | 15.93 | 41 | 0 | 468 |
| 0.600 | 12 | 12.6 | 39.8 | 15.54 | 45 | 0 | 471 |
| 0.650 | 12 | 12.6 | 42.6 | 15.13 | 49 | 0 | 466 |
| 0.700 | 12 | 12.6 | 45.2 | 14.69 | 52 | 0 | 468 |
| 0.750 | 12 | 12.6 | 41.5 | 14.23 | 56 | 0 | 448 |
| 0.800 | 12 | 12.6 | 49.7 | 13.74 | 60 | 0 | 420 |
| 0.850 | 12 | 12.6 | 51.7 | 13.23 | 64 | 0 | 387 |
| 0.900 | 12 | 12.6 | 53.5 | 12.71 | 68 | 0 | 346 |
| 0.950 | 12 | 12.6 | 55.1 | 12.16 | 71 | 0 | 300 |
| 1.000 | 12 | 12.6 | 56.5 | 11.60 | 75 | 0 | 248 |
| 1.050 | 12 | 12.6 | 57.6 | 11.03 | 79 | 0 | 191 |
| 1.100 | 12 | 12.6 | 58.5 | 10.45 | 83 | 0 | 131 |
| 1.150 | 12 | 12.6 | 59.1 | 9.87 | 87 | 0 | 68 |
| 1.200 | 12 | 12.6 | 59.5 | 9.27 | 90 | 0 | 4 |
| 1.250 | 12 | 12.6 | 59.6 | 8.68 | 94 | 0 | −57 |
| 1.300 | 12 | 12.6 | 59.5 | 8.08 | 98 | 0 | −118 |
| 1.350 | 12 | 12.6 | 59.0 | 7.49 | 102 | 0 | −177 |
| 1.400 | 12 | 12.6 | 58.3 | 6.90 | 105 | 0 | −234 |
| 1.450 | 12 | 12.6 | 57.3 | 6.32 | 109 | 0 | −286 |
| 1.500 | 20 | 12.6 | 56.3 | 5.76 | 113 | 0 | −479 |
| 1.550 | 20 | 13.5 | 60.4 | 5.19 | 117 | 0 | −1778 |
| | | | LOAD ZONE ENTERED - START FINE PRINT INTERVAL | | | | |
| 1.570 | 20 | 14.5 | 64.3 | 4.94 | 119 | 206 | −16082 |
| 1.580 | 20 | 15.0 | 66.1 | 4.81 | 119 | 219 | −16670 |
| 1.590 | 20 | 15.6 | 67.8 | 4.68 | 120 | 232 | −17473 |
| 1.600 | 20 | 16.1 | 69.6 | 4.55 | 121 | 246 | −18205 |
| 1.610 | 20 | 16.7 | 71.3 | 4.41 | 122 | 260 | −18895 |
| 1.620 | 20 | 17.3 | 72.7 | 4.27 | 123 | 274 | −19470 |
| 1.630 | 20 | 17.8 | 73.7 | 4.12 | 124 | 288 | −19976 |
| 1.640 | 20 | 18.3 | 74.4 | 3.98 | 126 | 303 | −20436 |
| 1.650 | 20 | 18.7 | 74.7 | 3.83 | 127 | 318 | −20850 |
| 1.660 | 20 | 19.0 | 74.6 | 3.68 | 128 | 333 | −21231 |
| 1.670 | 20 | 19.2 | 74.1 | 3.53 | 129 | 347 | −21574 |
| 1.680 | 20 | 19.4 | 73.2 | 3.38 | 130 | 362 | −21917 |
| 1.690 | 20 | 19.4 | 72.0 | 3.24 | 131 | 377 | −22262 |
| 1.700 | 20 | 19.4 | 70.6 | 3.10 | 132 | 391 | −22590 |
| 1.710 | 20 | 19.4 | 69.0 | 2.96 | 134 | 405 | −22916 |
| 1.720 | 20 | 19.3 | 67.4 | 2.82 | 135 | 419 | −23227 |
| 1.730 | 20 | 19.2 | 65.7 | 2.69 | 136 | 432 | −23512 |
| 1.740 | 20 | 19.1 | 64.1 | 2.56 | 137 | 445 | −23763 |
| 1.760 | 20 | 18.9 | 60.9 | 2.31 | 139 | 470 | −24131 |
| 1.770 | 20 | 18.9 | 59.4 | 2.18 | 141 | 482 | −24235 |
| 1.780 | 20 | 18.8 | 57.9 | 2.07 | 142 | 494 | −24281 |
| 1.790 | 20 | 18.8 | 56.5 | 1.95 | 143 | 578 | −27771 |
| 1.800 | 20 | 18.8 | 55.0 | 1.84 | 144 | 746 | −34836 |
| 1.810 | 20 | 18.7 | 53.2 | 1.73 | 145 | 908 | −41222 |
| 1.820 | 20 | 18.6 | 51.3 | 1.63 | 146 | 1066 | −46998 |
| 1.830 | 20 | 18.5 | 49.4 | 1.53 | 147 | 1218 | −52162 |
| 1.840 | 20 | 18.3 | 47.4 | 1.43 | 148 | 1364 | −56723 |
| 1.850 | 20 | 18.1 | 45.5 | 1.34 | 149 | 1504 | −60681 |
| 1.860 | 20 | 17.9 | 43.6 | 1.25 | 151 | 1638 | −64063 |
| 1.870 | 20 | 17.7 | 41.7 | 1.16 | 152 | 1767 | −66879 |

-continued

| | | | | | | | |
|---|---|---|---|---|---|---|---|
| 1.880 | 20 | 17.5 | 39.9 | 1.08 | 153 | 1890 | −69167 |
| 1.890 | 20 | 17.4 | 38.2 | 1.00 | 154 | 2012 | −71100 |
| 1.900 | 20 | 17.2 | 36.5 | 0.93 | 155 | 2192 | −74688 |
| 1.910 | 20 | 17.0 | 34.8 | 0.85 | 156 | 2364 | −77526 |
| 1.920 | 20 | 16.9 | 33.1 | 0.79 | 157 | 2527 | −79678 |
| 1.930 | 20 | 16.7 | 31.4 | 0.72 | 158 | 2683 | −81173 |
| 1.940 | 20 | 16.5 | 29.7 | 0.66 | 159 | 2830 | −82042 |
| 1.950 | 20 | 16.3 | 28.1 | 0.60 | 160 | 2970 | −82334 |
| 1.960 | 20 | 16.2 | 26.5 | 0.55 | 161 | 3102 | −82085 |
| 1.970 | 20 | 16.0 | 25.0 | 0.49 | 162 | 3200 | −80676 |
| 1.980 | 20 | 15.8 | 23.5 | 0.45 | 163 | 3200 | −76686 |
| 1.990 | 20 | 15.7 | 22.2 | 0.40 | 164 | 3200 | −72716 |
| 2.000 | 20 | 15.6 | 20.9 | 0.36 | 164 | 3200 | −68737 |
| 2.010 | 20 | 15.5 | 19.7 | 0.32 | 165 | 3200 | −64741 |
| 2.020 | 20 | 15.5 | 18.5 | 0.28 | 166 | 3200 | −60716 |
| 2.030 | 20 | 15.6 | 17.4 | 0.24 | 167 | 3200 | −56654 |
| 2.040 | 20 | 15.7 | 16.3 | 0.21 | 168 | 3200 | −52546 |
| 2.050 | 20 | 15.8 | 15.2 | 0.18 | 169 | 3200 | −48382 |
| 2.060 | 20 | 16.0 | 14.0 | 0.15 | 170 | 3200 | −44154 |
| 2.070 | 20 | 16.2 | 12.8 | 0.12 | 171 | 3200 | −39855 |
| 2.080 | 20 | 16.4 | 11.6 | 0.10 | 172 | 3200 | −35479 |
| 2.090 | 20 | 16.7 | 10.3 | 0.08 | 173 | 3200 | −31019 |
| 2.100 | 20 | 17.0 | 9.0 | 0.06 | 174 | 3200 | −26471 |
| 2.110 | 20 | 17.3 | 7.5 | 0.04 | 175 | 3200 | −21832 |
| 2.120 | 20 | 17.6 | 6.0 | 0.03 | 176 | 3200 | −17102 |
| 2.130 | 20 | 17.9 | 4.4 | 0.02 | 177 | 3200 | −12280 |
| 2.140 | 20 | 18.3 | 2.7 | 0.01 | 178 | 1267 | −2921 |
| 2.150 | 20 | 18.6 | 0.9 | 0.01 | 179 | 128 | −96 |
| 2.160 | 20 | 18.9 | 1.0 | 0.01 | 181 | 0 | 17 |
| LOAD ZONE COMPLETE - RESUME COARSE PRINT INTERVAL | | | | | | | |
| 2.200 | 20 | 19.5 | 9.0 | 0.05 | 185 | 0 | 2 |
| 2.250 | 20 | 19.6 | 19.0 | 0.19 | 191 | 0 | 2 |
| 2.300 | 20 | 19.6 | 28.8 | 0.42 | 197 | 0 | 1 |
| 2.350 | 20 | 19.6 | 38.3 | 0.76 | 203 | 0 | 1 |
| 2.400 | 20 | 19.7 | 47.3 | 1.19 | 209 | 0 | 1 |
| 2.450 | 20 | 19.7 | 55.8 | 1.71 | 215 | 0 | 1 |
| 2.500 | 20 | 19.7 | 63.7 | 2.30 | 221 | 0 | 3 |
| 2.550 | 20 | 19.8 | 70.8 | 2.98 | 227 | 0 | 7 |
| 2.600 | 20 | 19.8 | 77.0 | 3.72 | 232 | 0 | 12 |
| 2.650 | 20 | 19.8 | 82.4 | 4.51 | 238 | 0 | 18 |
| 2.700 | 20 | 19.8 | 86.7 | 5.36 | 244 | 0 | 24 |
| 2.750 | 20 | 19.8 | 90.1 | 6.25 | 250 | 0 | 30 |
| 2.800 | 20 | 19.9 | 92.4 | 7.16 | 256 | 0 | 34 |
| 2.850 | 20 | 19.9 | 93.6 | 8.09 | 262 | 0 | 35 |
| 2.900 | 20 | 19.9 | 93.8 | 9.03 | 268 | 0 | 33 |
| 2.950 | 20 | 19.9 | 92.9 | 9.96 | 274 | 0 | 26 |
| 3.000 | 12 | 18.9 | 82.5 | 10.87 | 280 | 0 | 3114 |
| 3.050 | 12 | 10.6 | 42.3 | 11.52 | 284 | 0 | 3480 |
| 3.100 | 12 | 8.0 | 36.1 | 11.90 | 287 | 0 | −957 |
| 3.150 | 12 | 10.3 | 47.6 | 12.30 | 290 | 0 | −2591 |
| 3.200 | 12 | 12.9 | 54.6 | 12.81 | 293 | 0 | −673 |
| 3.350 | 12 | 12.2 | 45.7 | 14.31 | 304 | 0 | −477 |
| 3.400 | 12 | 12.3 | 43.6 | 14.76 | 308 | 0 | −509 |
| 3.450 | 12 | 12.3 | 41.3 | 15.18 | 312 | 0 | −507 |
| 3.500 | 12 | 12.3 | 38.8 | 15.58 | 316 | 0 | −497 |
| 3.550 | 12 | 12.4 | 36.0 | 15.95 | 319 | 0 | −486 |
| 3.600 | 12 | 12.3 | 33.1 | 16.30 | 323 | 0 | −471 |
| 3.650 | 12 | 12.3 | 30.1 | 16.62 | 327 | 0 | −449 |
| 3.700 | 12 | 12.3 | 27.1 | 16.90 | 330 | 0 | −420 |
| 3.750 | 12 | 12.3 | 23.9 | 17.16 | 334 | 0 | −383 |
| 3.800 | 12 | 12.4 | 20.6 | 17.38 | 338 | 0 | −340 |
| 3.850 | 12 | 12.4 | 17.3 | 17.57 | 341 | 0 | −292 |
| 3.900 | 12 | 12.4 | 13.9 | 17.73 | 345 | 0 | −239 |
| 3.950 | 12 | 12.4 | 10.5 | 17.85 | 349 | 0 | −182 |
| 4.000 | 12 | 12.4 | 7.0 | 17.93 | 353 | 0 | −123 |
| 4.050 | 12 | 12.4 | 3.5 | 17.99 | 356 | 0 | −61 |
| 4.100 | 12 | 12.4 | 0.0 | 18.00 | 360 | 0 | |

SUMMARY OF STROKE 3
AVE. STROKING RATE 14.63 SPM
RMS MOTOR HP. 755.7
AVE. MOTOR HP. 712.0
AVE. CLUTCH DISS. HP. 172.2
AVE. BRAKE DISS. HP. −162.8
AVE. WORK HP. 383.9
AVE. FLYWHEEL HP. LOSS −3.5
RELATIVE STABILITY HAS BEEN REACHED
ANALYSIS COMPLETE

It can be seen from the above data that the "reference SPM" of the system was set at 12 for the "open" portion of the press cycle, and at 22 for the "closed" portion of the cycle. During a portion of the press downstroke in the "open" portion of the cycle, i.e., within the crank angle range of 52° to 98°, the eddy current brake was energized to maintain the press at the commanded slow speed. When the commanded speed was increased by changing the "reference SPM" to 20, just before the load zone was entered, the eddy current clutch was energized to supply the necessary power to both increase the speed of the press drive and perform the desired work. The "reference SPM" was maintained at 20 through the balance of the downstroke and 89° of the upstroke, and then reduced to 12 again. It can be seen that the brake was again energized, to reduce the press speed, as soon as the "reference SPM" was reduced. With this system, the stroke length was only 18 inches, and yet ample time (2.55 sec.) was allowed for the feed mechanism to access the workstations during the "open" portion of the cycle.

Figure 9:
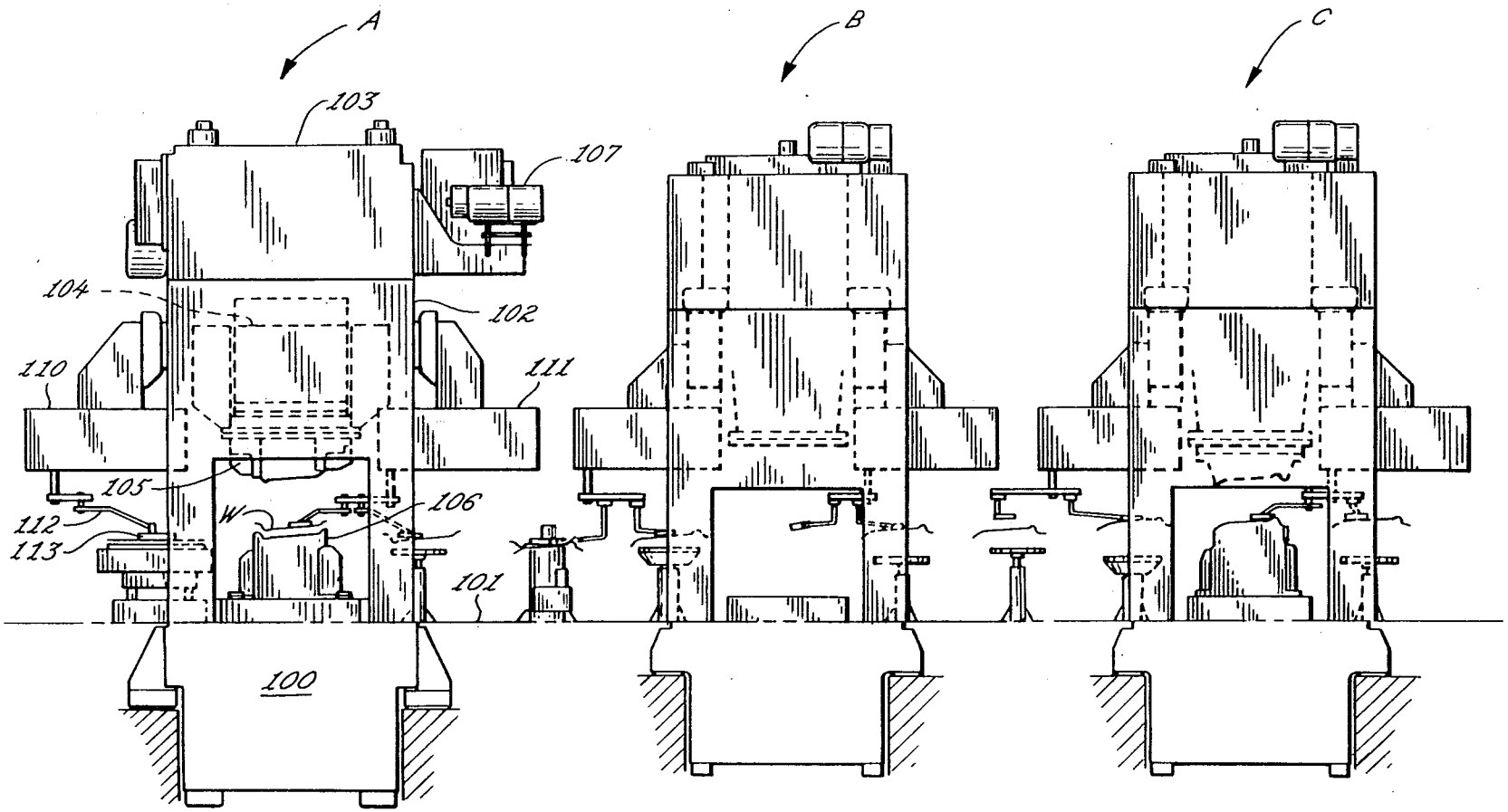
FIG. 9 is a side elevation of a synchronized line of single-station presses each of which has a loading mechanism and an unloading mechanism associated therewith.

As mentioned previously, the present invention is useful not only in transfer presses, which have multiple workstations within a single press, but also in single-station presses operating alone or in a synchronized line of such presses. An exemplary line of single-station presses is illustrated in FIG. 9, which is similar to the synchronized press lines described in Danly U.S. Pat. Nos. 3,199,439 and 3,199,443. As described in those patents, such a press line performs successive operations upon a workpiece W, and may be extended to include any desired number of presses. Each individual press includes a base 100 extending below the floor level 101, and an upperly extending frame 102 topped by a crown 103. Recriprocatingly mounted in the press frame is a slide 104 carrying a die 105 for cooperating with a lower die 106 with the slide being driven by a motor 107.

Each of the three presses A, B and C is provided with a loading mechanism 110 for loading workpieces into the working area of the press, and an unloading mechanism 111 for removing workpieces from the work area. These loading and unloading mechanisms are cantilevered from opposite sides of the main frame of the press. Depending from each loading and unloading mechanism 110 and 111 is a transfer arm 112 having a gripper 113 for gripping the workpieces while they are being transferred. The details of these loading and unloading mechanisms are well known in the art and, therefore, need not be described in detail here. The details of how to synchronize such a line of multiple presses are also well known in the art, and one version thereof is described in the aforementioned Danly U.S. Pat. No. 3,199,439.

The reason for describing the synchronized press line here is to illustrate one of the most useful applications of the present invention. It will be appreciated that in a line of multiple presses, each having its own loading and unloading mechanism, a considerable amount of time is required in each cycle to allow the loading and unloading mechanisms to move the workpieces in and out of the workstations of the respective presses. In the past, the necessary cycle time for these operations has been provided by increasing the strokes of all the presses to allow adequate time for the press having the maximum cycle time. In certain situations this has required excessive vertical space or the re-design of the top portions of the presses in order to reduce their overall height. By applying the present invention to such a press line, however, adequate cycle time can be provided while at the same time reducing the size and cost of each individual press, along with all the other advantages of the invention described above. The resultant overall savings in a multi-press line of the type illustrated in FIG. 9 are quite significant.

The method of this invention can be implemented by retrofitting presses already in the field, particularly those presses equipped with inching drives. An inching drive provides a means to operate the press at a speed much slower than its normal cycle rate, typically providing full tonnage at a speed of one stroke per minute. Inching drives are well known and typically use an inching motor geared to a brake housing mounted on bearings so that the complete brake can be rotated. The housing is connected to an auxiliary brake which keeps the housing in a fixed position during normal operation of the press. For inching, the clutch is deenergized, the main brake is engaged, and the inching motor drives the press (at a reduced speed) through the main brake.

To inplement the present invention via an inching drive, a variable speed drive motor can be substituted for the conventional fixed speed inching drive motor.

I claim:

1. A method of controlling a press having a slide mechanism mounted for reciprocating movement, a press drive for cycling the slide mechanism and including a press drive shaft and means for driving said shaft at a controllable angular velocity, and an automated feed mechanism for transferring workpieces in and out of at least one work station in the press in synchronism with the reciprocating movement of the press slide, said method comprising the steps of driving the press drive shaft at a first, relatively fast angular velocity during a "closed" portion of each cycle of reciprocating movement of the press slide, said "closed" portion of each cycle including that portion of the cycle during which the press slide is working one or more workpieces, and driving the press drive shaft at a second angular velocity, slower than said first angular velocity, during an "open" portion of each cycle of reciprocating movement of the press slide, said second angular velocity being sufficiently slow to allow said automatic feed mechanism to transfer workpieces in and out of said work station in the press during said "open" portion of each cycle.

2. The method of claim 1 wherein said "closed" portion of each cycle includes the portion of the downstroke after the die carried by the press slide engages the workpiece, and the portion of the upstroke during which the die carried by the press slide is being withdrawn from the workpiece.

3. The method of claim 1 wherein said "open" portion of each cycle comprises at least 180° of a 360° cycle of reciprocating movement of the press slide.

4. The method of claim 1 in which the angular velocity of said drive shaft is controlled by the value of a reference signal, and said reference signal is set at a first constant value during said "closed" portion of each cycle and at a second constant value during said "open" portion of each cycle.

5. The method of claim 1 wherein said feed mechanism is movable along at least three different axes, and includes servo motors for controllably driving the feed mechanism along said different axes.

6. The method of claim 1 wherein said means for driving the press drive shaft comprises an electric drive motor connected to said shaft through an eddy current clutch and brake.

7. The method of claim 1 wherein said "open" portion of each cycle begins about when the press slide has been raised to an elevation that permits the feed mechanism to enter between the upper and lower dies.

8. The method of claim 1 wherein said "open" portion of each cycle begins during the upstroke of the press slide.

9. A method of controlling a press having a slide mechanism mounted for reciprocating movement, a press drive for cycling the slide mechanism and including a press drive shaft and means for driving said shaft at a controllable angular velocity, and an automated feed mechanism for transferring workpieces in and out of at least one work station in the press in synchronism with the reciprocating movement of the press slide, said method comprising the steps of driving the press drive shaft at a first, relatively fast angular velocity during a "closed" portion of each cycle of reciprocating movement of the press slide, said "closed" portion of each cycle including that portion of the cycle during which the press slide is working one or more workpieces, and driving the press drive shaft at an angular velocity slower than said first angular velocity during an "open" portion of each cycle of reciprocating movement of the press slide, said "open" portion of each cycle beginning during the upstroke of the press slide and continuing until about the point where the die carried by the slide impacts the workpiece, said slower angular velocity allowing adequate time for said feed mechanism to transfer workpieces in and out of said work stations in the press.

* * * * *